US010473103B2

(12) United States Patent
Keeran et al.

(10) Patent No.: US 10,473,103 B2
(45) Date of Patent: Nov. 12, 2019

(54) CHOPPER PUMP WITH DOUBLE-EDGED CUTTING BARS

(71) Applicant: Vaughan Company, Inc., Montesano, WA (US)

(72) Inventors: Kent Keeran, Elma, WA (US); Arne Swenson, Aberdeen, WA (US)

(73) Assignee: VAUGHAN COMPANY, INC., Montesano, WA (US)

( * ) Notice: Subject to any disclaimer, the term of this patent is extended or adjusted under 35 U.S.C. 154(b) by 366 days.

(21) Appl. No.: 15/457,405

(22) Filed: Mar. 13, 2017

(65) Prior Publication Data

US 2018/0258937 A1 Sep. 13, 2018

(51) Int. Cl.

| | |
|---|---|
| ***B02C 18/00*** | (2006.01) |
| ***F04D 7/04*** | (2006.01) |
| ***F04D 29/22*** | (2006.01) |

(52) U.S. Cl.

CPC ..... *F04D 7/045* (2013.01); *B02C 18/0092* (2013.01); *F04D 29/2288* (2013.01)

(58) Field of Classification Search

None

See application file for complete search history.

(56) References Cited

U.S. PATENT DOCUMENTS 3,155,046 A 11/1964 Vaughan
3,726,486 A * 4/1973 Smith ..... B02C 18/0092 241/244
3,973,866 A 8/1976 Vaughan
4,454,993 A * 6/1984 Shibata ..... F04D 7/045 241/46.017
4,630,780 A * 12/1986 Immel ..... B02C 18/18 241/46.017
4,842,479 A 6/1989 Dorsch
4,911,368 A * 3/1990 Nishimori ..... F04D 7/045 241/46.017
5,256,032 A * 10/1993 Dorsch ..... F04D 7/045 415/121.1
5,302,082 A * 4/1994 Gilbert ..... F04D 29/2288 241/185.6
5,460,482 A * 10/1995 Dorsch ..... F04D 7/045 415/121.1
5,460,483 A * 10/1995 Dorsch ..... B02C 18/0092 415/121.1
6,190,121 B1 * 2/2001 Hayward ..... F04D 7/045 415/121.1

(Continued)

*Primary Examiner* — Carlos A Rivera
*Assistant Examiner* — Theodore C Ribadeneyra
(74) *Attorney, Agent, or Firm* — Bishop, Diehl & Lee Ltd.

(57) ABSTRACT

An impeller assembly with an impeller and a cutter bar plate is used in a chopper pump system which handles liquid material sometimes entrained with large debris and stringy matter. The debris and matter present clogging hazards, which are reduced by a combination of scissoring between sharpened impeller blades and shearing fingers, and between cutting wings and shearing fingers. To make the cutting feature more aggressive, sharpened edges along two of the scissoring edges of the shearing fingers are utilized. Preferably, the sharpened edges are either the result of machined v-notches on the cutting surface of the shearing fingers or of a casted part having a cupped surface. Generally speaking, the impeller assembly comprises an impeller attached to a rotatable pump shaft and includes a back shroud.

18 Claims, 5 Drawing Sheets

(56) References Cited

U.S. PATENT DOCUMENTS 6,224,331 B1 * 5/2001 Hayward ..... F04D 7/045 415/121.1
7,080,797 B2 * 7/2006 Doering ..... F04D 7/045 241/185.6
7,125,221 B2 10/2006 Dorsch
7,461,804 B2 * 12/2008 Walters ..... B02C 18/362 241/292.1
7,607,884 B2 * 10/2009 Cohen ..... F04D 29/126 415/111
7,841,550 B1 * 11/2010 Dorsch ..... B02C 18/0092 241/46.017
8,105,017 B2 1/2012 Dorsch
8,905,341 B2 * 12/2014 Dorsch ..... F04D 7/045 241/46.017
2002/0146319 A1 * 10/2002 Dorsch ..... F04D 7/045 415/206
2005/0053461 A1 * 3/2005 Doering ..... F04D 7/045 415/121.1
2005/0207891 A1 * 9/2005 Shaw ..... F04D 29/2288 416/179
2007/0164136 A1 * 7/2007 Zelder ..... F04D 7/045 241/46.06
2008/0152481 A1 * 6/2008 Wagner ..... F04D 7/045 415/121.1
2009/0092479 A1 * 4/2009 Wagner ..... F04D 7/045 415/121.1
2010/0028136 A1 * 2/2010 Dorsch ..... F04D 7/045 415/121.1
2010/0143098 A1 * 6/2010 Sodergard ..... F04D 7/045 415/121.1
2010/0213298 A1 * 8/2010 Park ..... B02C 18/0092 241/101.2
2011/0129344 A1 * 6/2011 Burgess ..... F04D 29/2288 416/182
2012/0251319 A1 * 10/2012 Dorsch ..... F04D 7/045 416/146 R
2013/0108411 A1 * 5/2013 Ciotola ..... B02C 18/0092 415/1
2013/0121811 A1 * 5/2013 Cuppetelli ..... F04D 29/2288 415/121.1
2014/0064929 A1 * 3/2014 Adams ..... F04D 7/045 415/121.1
2014/0127021 A1 * 5/2014 Chiovelli ..... F01D 5/12 416/179
2014/0199165 A1 * 7/2014 Pohler ..... F04D 7/045 415/204
2014/0377055 A1 * 12/2014 Garvin ..... F04D 29/2288 415/121.1
2015/0023783 A1 * 1/2015 Dumonceaux ..... F04D 13/06 415/121.1
2015/0115081 A1 * 4/2015 Gormley ..... B02C 18/0092 241/46.015
2015/0115082 A1 * 4/2015 Gormley ..... E03C 1/2665 241/46.016
2015/0219098 A1 * 8/2015 Mehta ..... F04C 13/001 241/30
2015/0377246 A1 * 12/2015 Tieu ..... F04D 29/2266 416/189
2017/0306965 A1 * 10/2017 Bevington ..... F04D 29/2288

* cited by examiner

CHOPPER PUMP WITH DOUBLE-EDGED CUTTING BARS

TECHNICAL FIELD OF THE INVENTION

The present device relates to centrifugal pumps used for pumping liquids and slurries containing solid matter, including various types of refuse and debris. Specifically, the device relates to pumps having a cutter bar plate with the ability to reduce the size of such solid matter and prevent clogging on the upstream side of the chopper pump.

BACKGROUND OF THE INVENTION

Generally speaking, U.S. Pat. No. 3,155,046 to Vaughan, issued Nov. 3, 1964, discloses a centrifugal pump having a semi-open impeller with radial vanes. The vane edges adjacent to the pump inlet cooperate with sharpened leading edges of inlet apertures to cut stringy material or chunks entering the pump. Similarly, U.S. Pat. No. 3,973,866 to Vaughan, issued Aug. 10, 1976, and U.S. Pat. No. 4,842,479 to Dorsch, issued Jun. 27, 1989, disclose centrifugal pumps having impellers with vanes cooperating with inlet apertures to achieve a chopping or slicing action of solid material in a liquid or slurry being pumped. In the case of the pumps of U.S. Pat. No. 3,973,866 to Vaughan and U.S. Pat. No. 4,842,479 to Dorsch, however, semi-open impellers having shroud plates are used and external booster propellers may be provided to accelerate flow into the pump. The latter, when used, helps displace chunks of solid matter which become lodged in the inlet apertures and, at least in some instances cuts solid matter prior to entry into the pump.

One of the problems with each of these devices is the occurrence of motor overloading during heavy chopping. Where the chopping is not efficient, the motor power increases causing the motor protection controls to trip the motor offline. When the motor goes offline, the chopping stops and operator intervention is required to place the motor back online. The chopping down-time, of course, detracts from the cost effectiveness of the process.

Stringy material also presents a problem. The material becomes wrapped around the turning parts of the impeller assembly and can lead to plugging of the chopper pump inlet.

It is therefore desirable to provide an impeller assembly which helps maintain a clear cutting area, reduces cutting part wear and improves chopping efficiency to reduce motor power load and chopping down-time. It also would be desirable to provide an assembly which aggressively reduces the build-up and collection of stringy material, particularly around the external tool of the impeller assembly. The disclosed device affords other structural, manufacture and operating efficiencies not seen in prior art devices, as well.

SUMMARY OF THE INVENTION

There is disclosed herein an improved impeller assembly for a chopper pump. Generally speaking, the assembly comprises an impeller having a back shroud and cutting blades sharpened on a first edge, a cutter bar plate, and an external tool.

In a specific embodiment, the assembly comprises an impeller with cutting blades extending from and fixed on a first surface of the back shroud, and a cutter bar plate positioned adjacent to and upstream of the impeller, the cutter bar plate comprising at least one shearing finger having first and second contact surfaces and extending inward from a periphery, the first contact surface of the at least one shearing finger having a first sharpened edge such that the first sharpened edge creates a shearing operation in combination with the sharpened edge of the cutting blades of the impeller during use. Further, the embodiment includes an external tool positioned adjacent to and upstream of the cutter bar plate, the external tool comprising at least one cutting wing having a shearing surface that creates a shearing operation in combination with a second sharpened edge along the second contact surface of the shearing finger during use.

In other specific embodiments, the first sharpened edge has a length which is substantially equal to a length of the at least one shearing finger, while the second sharpened edge has a length which is substantially equal to a length of the at least one cutting wing. Accordingly, the second sharpened edge preferably has a length which is substantially less than the length of the first sharpened edge. Preferably, the first and second sharpened edges are both machined v-notches in the shearing finger and each is on a first cutting face of the at least one shearing finger. More preferably, the first and second sharpened edges are the result of casting of the shearing finger to create a cupped surface.

In specific embodiments, a gap between the at least one shearing finger and the cutting wing is in the range of from about 0.010 to 0.030 inches. Similarly, a gap between the at least one shearing finger and the sharpened edge of the cutting blades is in the range of from about 0.010 to 0.030 inches. Most preferably, the two gaps are in the range of from about 0.015 to about 0.025 inches.

A cutter bar plate for an impeller assembly in a chopper pump is also disclosed and claimed. A preferred cutter bar plate comprises a body configured to be positioned upstream from an impeller of a chopper pump, wherein the body comprises first and second opposing surfaces, the first surface being configured to face downstream and the second surface being configured to face upstream, and an opening defined through the body which allows material to flow past the first and second opposing surfaces, and at least one shearing finger fixed to the body and extending into the opening parallel to the first and second surfaces, wherein the at least one shearing finger comprises a front face normal to the first and second surfaces and having first and second contact surfaces. The shearing finger includes a first sharpened edge disposed on the first contact surface and a second sharpened edge disposed on the second contact surface.

In a specific embodiment, there are two shearing fingers and each comprises an aggressive curved-hook end.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF PREFERRED EMBODIMENTS

Figure 1:
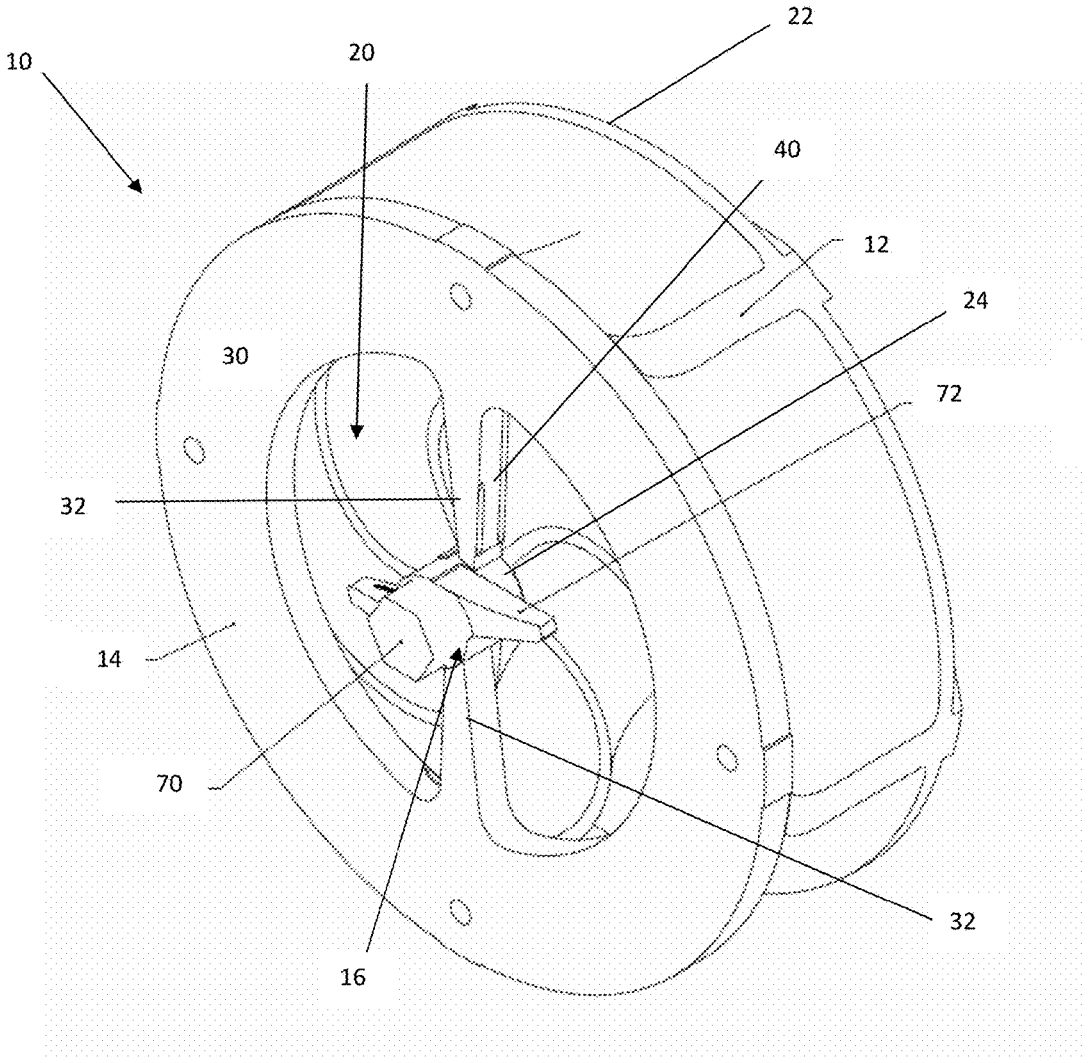
FIG. 1 is a perspective view of an embodiment of an impeller assembly in accordance with the present disclosure.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to embodiments illustrated.

Referring to FIGS. 1-6, there is illustrated in the several views a chopper pump impeller assembly, generally designated by the numeral 10, and various components of the assembly 10. Generally speaking, the assembly 10 has a centrifugal impeller 12, a cutter bar plate 14, and an external tool 16. The impeller assembly 10 is designed for use in a chopper pump system such as the one described in U.S. Pat. No. 7,125,221 and in U.S. Pat. No. 8,105,017, both assigned to Vaughan Company, Inc. of Montesano, Wash. The '221 and '017 patents are hereby incorporated by reference.

As shown in the embodiment of FIG. 1, the impeller 12 has a series of radially extending blades 20 and a back shroud 22 to which the blades are attached. The illustrated impeller 12 is called a semi-open impeller due to the use of the back shroud 22 on one side. The impeller 12 connects to a motor and shaft (not shown) from the central hub 24. As the impeller 12 turns, discharge pressure is created as material is pushed through the impeller 12. Most of the material is liquid, suspended solid particle, and small debris. This material is easily discharged from the impeller chamber (i.e., the housing of the impeller) as a result of the fluid velocity created by the turning impeller 12. However, large debris and stringy material can cause problems by blocking the inlet side and/or wrapping around the impeller 12. As a means for helping reduce such problems, the upstream edges of the impeller blades 20 are sharpened for cutting action.

To assist the cutting action, the cutter bar plate 14 attaches to and is fixed at the inlet side of the impeller assembly 10, as shown. A gap in the range of from about 0.005 inch (0.127 mm) to about 0.050 inches (1.27 mm) is maintained to create a scissoring between the impeller blades 20 and the cutter bar plate 14. Preferably, the gap is in the range of from about 0.010 (0.254 mm) to about 0.030 inches (0.762 mm), and most preferably within the range of from about 0.015 (0.381 mm) to 0.025 inches (0.635 mm).

The cutter bar plate 14 is comprised of a planar ring-shaped body 26 having an upstream surface 30 and a downstream surface (not shown). The central region of the cutter bar plate 14 is open to allow material to pass through to the impeller 12. However, at least one shearing finger 32, and preferably two shearing fingers 32 extend into the opening. The shearing fingers 32 are preferably extensions of the inner surface 33 of the cutter bar plate 14.

Each finger 32 has a front surface 40 and a backside surface 42. At the end of each shearing finger 32 on the front surface is a curved hook 44. This feature presents another cutting edge to help reduce clogging of the impeller by debris. The front surface 40 also includes a first contact surface (or junction) 50 where the front surface 40 meets the upstream surface 30 of the finger 32, as well as a second contact surface (or junction) 52 where the front surface 40 meets the downstream surface of the finger 32.

Figure 3:
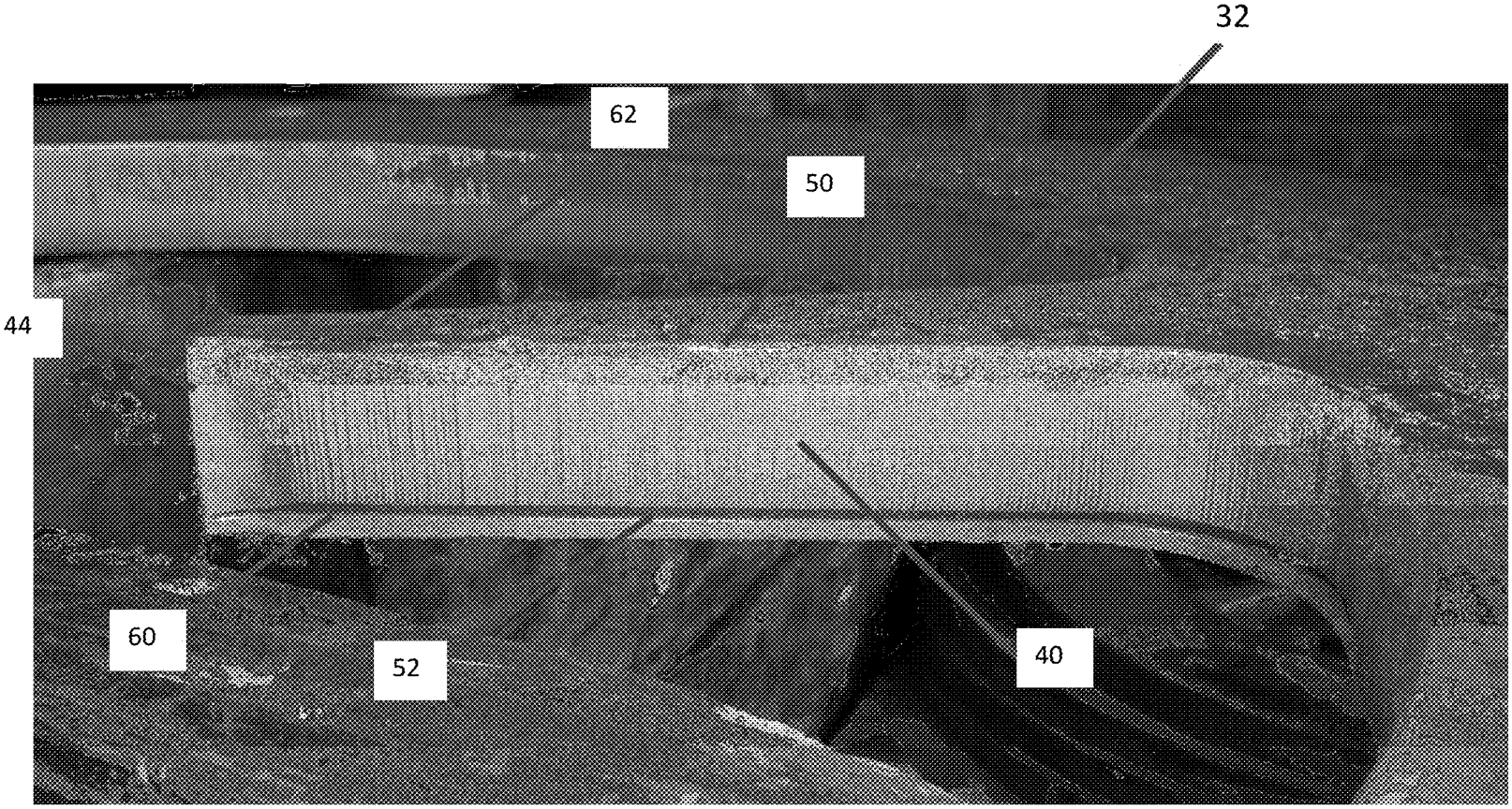
FIG. 3 is a close-up view of an embodiment of a shearing finger.

When the cutter bar plate 14 is positioned for use, the curved radial blades 20 scissor against the shearing fingers 32 as the impeller 12 turns. A first sharpened edge 60 along the second contact surface 52 of the shearing finger 32 helps in the reduction of clogging debris. The first sharpened edge 60, as shown best in FIG. 3, is a v-notch machined into the finger surface 52. Preferably, the sharpened edge 60 extends the entire length of the finger 32 and may even extend along the shared interior surface of the body 26.

In addition to the cutting action of the impeller blades 20 and the shearing fingers 32, an external tool 16 is positioned adjacent to and upstream of the cutter bar plate 14. The tool 16 includes hex body 70 and cutting wings 72, of which there are preferably two wings 72. The external tool 16 is connected to the impeller 12, so it also moves during operation. Like the gap between the shearing fingers 32 and the impeller blades 20, the cutting wings 72 are similarly gapped from the shearing fingers 32. That is, the gap is in a range of from about 0.005 inch (0.127 mm) to about 0.050 inches (1.27 mm) to create a scissoring between the cutting wings 72 and the shearing fingers 32. Preferably, the gap is in the range of from about 0.010 (0.254 mm) to about 0.030 inches (0.762 mm), and most preferably within the range of from about 0.015 (0.381 mm) to 0.025 inches (0.635 mm).

Figure 2:
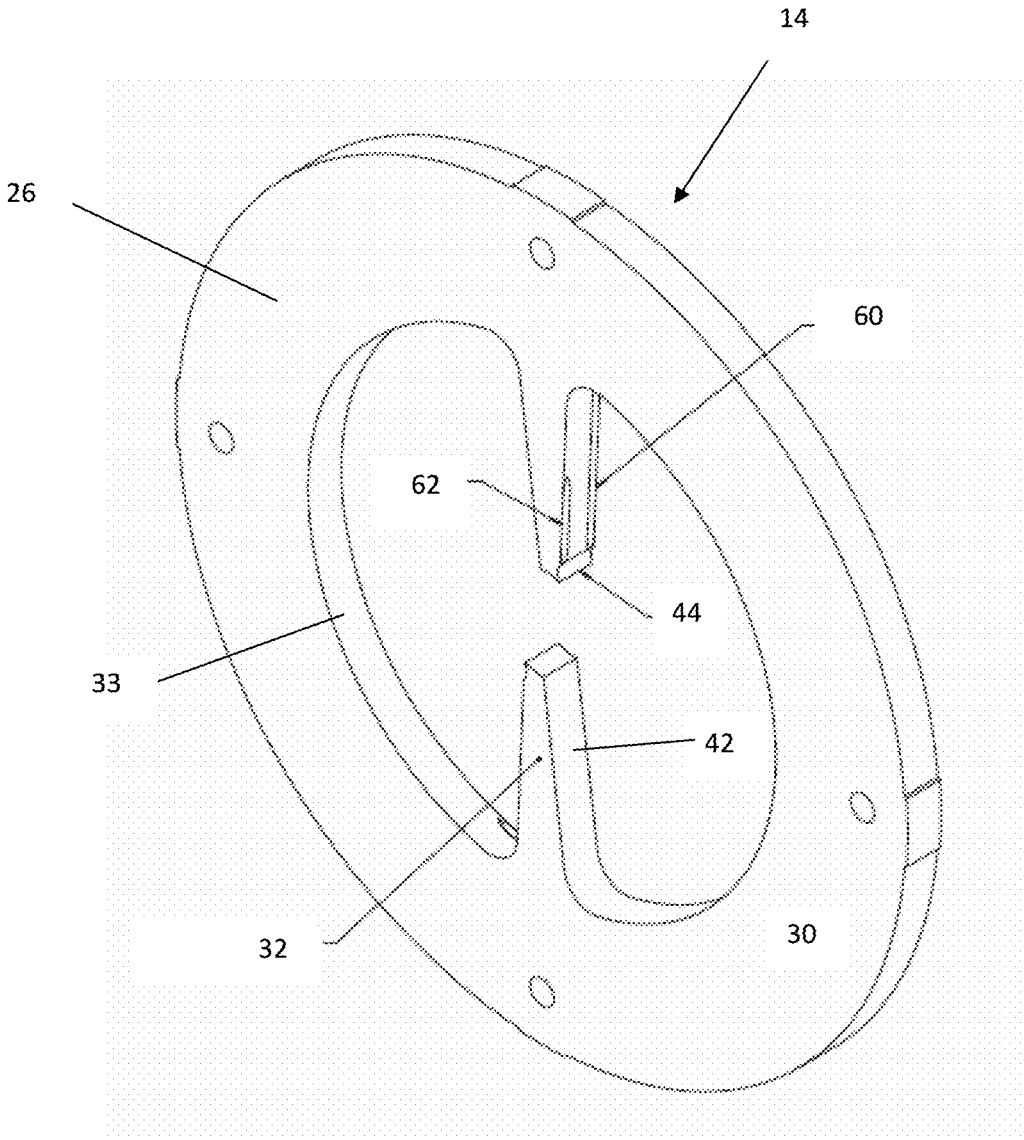
FIG. 2 is a perspective view of an embodiment of a cutter bar plate in accordance with the present disclosure.

A second sharpened edge 62 is shown as a v-notch machined into the first contact surface 50 of the shearing finger 32. Where the edge 62 is a machined notch, as illustrated in FIGS. 1-3, the second sharpened edge 62 may have a shorter length than the first sharpened edge 60 to account for the fact that the cutting wings 72 do not extend the length of the shearing finger 32. However, the use of longer cutting wings 72 on the external tool 16 would give rise to the use of a longer second sharpened edge 62 on the first contact surface 50.

Figure 6A:
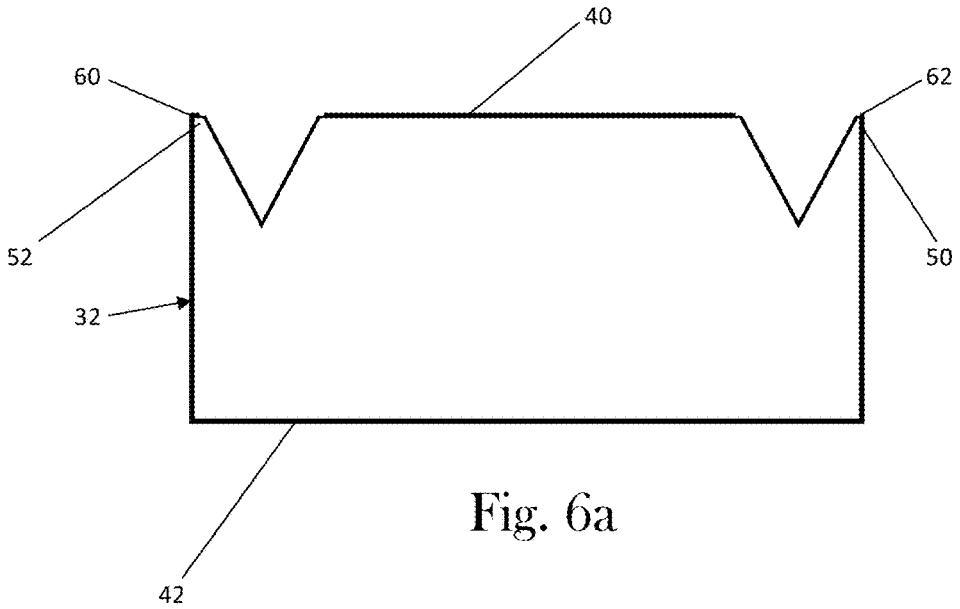
FIG. 6*a* is a cross-sectional view of an embodiment of a shearing finger having machined v-notches to create two sharpened edges.
Figure 6B:
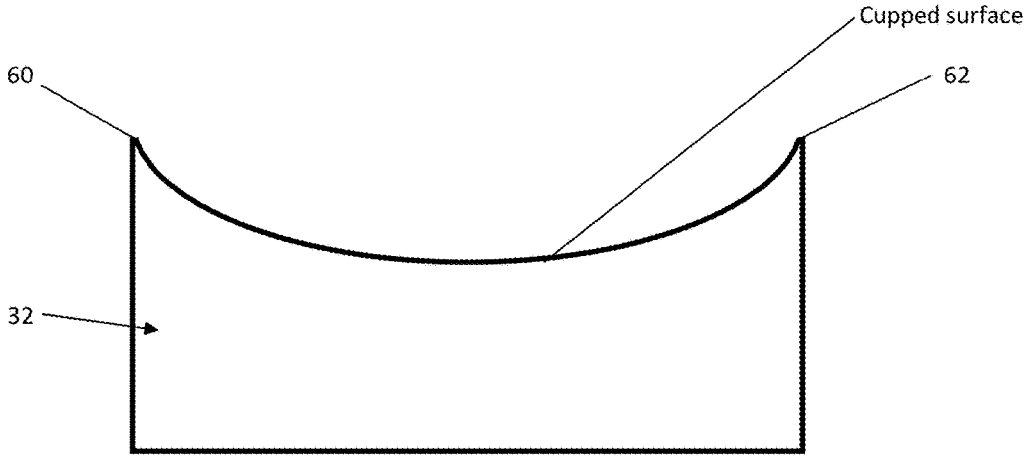
FIG. 6*b* is a cross-sectional view of another embodiment of a shearing finger casted to create two sharpened edges.

As previously mentioned, the first and second sharpened edges, 60 and 62, are preferably machined v-notches made in the front surface 40 of the shearing finger 32, as illustrated in the cross-section of finger 32 in FIG. 6*a*. The v-notch shape is believed to provide a sufficiently sharp edge for an aggressive cutting action. However, casting the shearing finger 32 (and the entire cutter bar plate 14) is even more preferred. Casting would allow the sharpened edges, 60 and 62, to be made by casting a shearing finger 32 having a cross section as shown in FIG. 6*b*. Like the v-notch, the "scallop" or cupped-shape also provides aggressive cutting edges on the front face of the shearing finger 32. Other shapes and sharp cutting edge configuration might provide similar or even better results in different applications.

Figure 4:
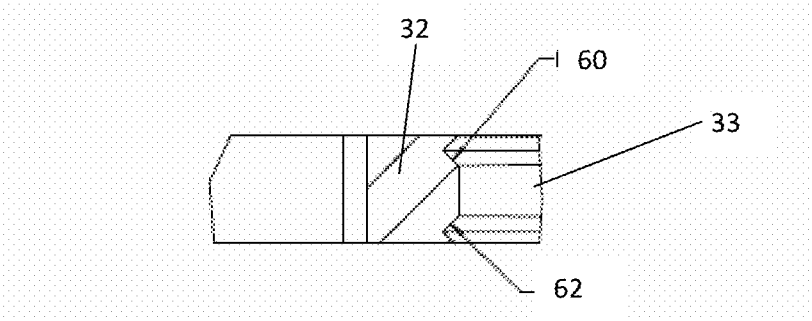
FIG. 4 is a cut-away top view of an embodiment of a shearing finger positioned on the inner surface of the cutter bar plate.
Figure 5:
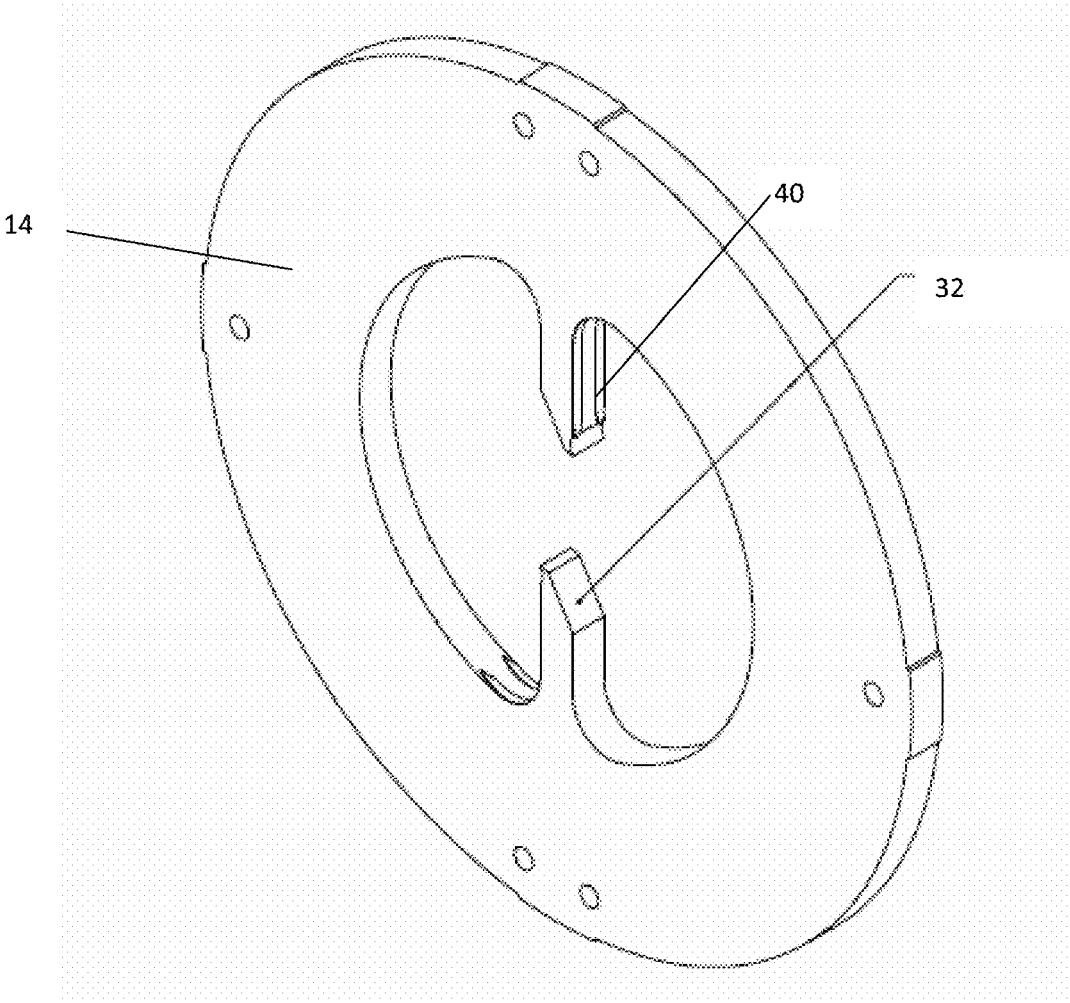
FIG. 5 is a perspective view of an alternate embodiment of a cutter bar plate in accordance with the present disclosure.

With reference to FIG. 4, an alternate embodiment of the cutter bar plate 14 is shown.

Two exemplary installations of chopper pump systems using the disclosed impeller assembly 10 are described below:

Exemplary Installation #1

In 2015, four (4) model HE12W chopper pumps were installed at a Manatee County water treatment facility. Each pump comprised standard cutter bar plates having single notched shearing fingers. The pumps were brought online at a rate of about one unit per month over a period of a few months. Shortly thereafter, reports began coming in from Manatee County maintenance that all four pumps were experiencing periodic plugging at the pump suction side. Plugging would occur approximately once per month on each pump as debris would build-up over time on the pump suction side. As a result of the plugging, each pump would need to be shut down, unplugged, and then restarted on a monthly basis. This practice is both time consuming and costly.

In May 2016, all four model HE12W pumps were upgraded with double notch cutter bar plates. Over an eight (8) month period there have been no reports of clogging on any of the four pumps.

Exemplary Installation #2

A chopper pump having a single notch cutter bar plate was installed at the City of Detroit. Each month the pump would show wrapping of material behind the external tool. A double notch cutter bar plate was installed in late 2016 and after two months has shown no sign of wrapping.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. An impeller assembly for a chopper pump comprising:

an impeller having a back shroud and cutting blades sharpened on a first edge, the cutting blades extending from and fixed on a first surface of the back shroud;

a cutter bar plate positioned adjacent to and upstream of the impeller, the cutter bar plate comprising at least one shearing finger having first and second contact surfaces and extending inward from a periphery, the first contact surface of the at least one shearing finger having a first sharpened edge and the second contact surface having a second sharpened edge, such that the first sharpened edge creates a shearing operation in combination with the sharpened edge of the cutting blades of the impeller during use; and an external tool positioned adjacent to and upstream of the cutter bar plate, the external tool comprising at least one cutting wing having a shearing surface that creates a shearing operation in combination with the second sharpened edge along the second contact surface of the shearing finger during use;

wherein the first and second sharpened edges comprise machined v-notches.

2. The assembly of claim 1, wherein the first sharpened edge has a length which is equal to a length of the at least one shearing finger.

3. The assembly of claim 2, wherein the second sharpened edge has a length which is equal to a length of the at least one cutting wing.

4. The assembly of claim 2, wherein the second sharpened edge has a length which is less than the length of the first sharpened edge.

5. The assembly of claim 4, wherein the first and second sharpened edges are each on a first contacting face of the at least one shearing finger.

6. The assembly of claim 1, wherein a shearing gap in an axial direction between the at least one shearing finger and the cutting wing is in the range of from about 0.010 to 0.030 inches.

7. The assembly of claim 6, wherein the gap is in the range of from about 0.015 to 0.025 inches.

8. The assembly of claim 1, wherein a shearing gap in an axial direction between the at least one shearing finger and the sharpened edge of the cutting blades is in the range of from about 0.010 to 0.030 inches.

9. The assembly of claim 8, wherein the gap is in the range of from about 0.015 to 0.025 inches.

10. The assembly of claim 1, wherein the cutter bar plate comprises two shearing fingers.

11. A cutter bar plate for a chopper pump, the cutter bar plate comprising:

a body configured to be positioned upstream from an impeller of a chopper pump, wherein the body comprises first and second opposing surfaces, the first surface being configured to face downstream and the second surface being configured to face upstream, and an opening defined through the body which allows material to flow past the first and second opposing surfaces; and at least one shearing finger fixed to the body and extending into the opening parallel to the first and second surfaces, wherein the at least one shearing finger comprises a front face normal to the first and second surfaces of the body, the front face having first and second contact surfaces;

wherein the shearing finger comprises v-notches in the front face to create a first sharpened edge disposed on the first contact surface and a second sharpened edge disposed on the second contact surface.

12. The cutter bar plate of claim 11, wherein the first sharpened edge has a length which is equal to a length of the at least one shearing finger.

13. The cutter bar plate of claim 12, wherein the second sharpened edge has a length which is less than the length of the first sharpened edge.

14. The cutter bar plate of claim 11, wherein the at least one shearing finger comprises a curved-hook end.

15. The cutter bar plate of claim 11, comprising two shearing fingers.

16. The cutter bar plate of claim 15, comprising two shearing fingers extending from the inner surface.

17. The cutter bar plate of claim 11, wherein the body comprises an outer ring having an inner surface defining the opening, and the at least one shearing finger extends from the inner surface.

18. The cutter bar plate of claim 17, wherein each of the two shearing fingers comprises a curved-hook end.

* * * * *